US006422507B1

(12) United States Patent
Lipeles

(10) Patent No.: US 6,422,507 B1
(45) Date of Patent: Jul. 23, 2002

(54) SMART BULLET

(76) Inventor: Jay Lipeles, 461 Majestic Oak Dr., Apopka, FL (US) 32712

( * ) Notice: Subject to any disclaimer, the term of this patent is extended or adjusted under 35 U.S.C. 154(b) by 0 days.

(21) Appl. No.: 09/608,987

(22) Filed: Jun. 30, 2000

Related U.S. Application Data

(60) Provisional application No. 60/142,146, filed on Jul. 2, 1999.

(51) Int. Cl.[7] ..... F41G 7/24

(52) U.S. Cl. ..... 244/3.13; 244/3.11; 244/3.23; 244/3.24; 244/3.27; 89/1.11; 102/501

(58) Field of Search ..... 244/3.1–3.14, 244/3.23–3.3, 3.15–3.22; 89/1.805–1.808, 1.11; 102/501

(56) References Cited

U.S. PATENT DOCUMENTS 4,223,324 A 9/1980 Yamamori et al.
5,139,216 A * 8/1992 Larkin ..... 244/3.21

FOREIGN PATENT DOCUMENTS

EP 765751 4/1997

OTHER PUBLICATIONS

English Abstract of Japanese Application 05149037, 1995.
English Abstract of Japanese Application 1–82962.
Jay Lipeles: Proposal for development funding for "Innovative Air and Surface Weapons" Aug. 18, 1998.

* cited by examiner

*Primary Examiner*—Bernarr E. Gregory
(74) *Attorney, Agent, or Firm*—David G. Maire; Beusse Brownlee Bowdoin & Wolter P.A.

(57) ABSTRACT

A smart bullet capable of in-flight maneuvers generated by the selective extension of a spoiler from a de-spun control section of the bullet into the stream of air passing the bullet. A micro gyro located in the control section provides a rotation signal used in the control of a motor rotatably attached between the control section and a spinning section of the bullet. A rearward facing lens and optical detector receive guidance information from a gun-mounted guidance system. The direction of extension of the spoiler is selectively controlled by controlling the operation of the motor in response to the guidance information. The detector and pre-amplifier circuit are bonded to the lens structure to minimize microphonic noise generation. An optical link is used to communicate information between the spinning and control sections of the bullet.

18 Claims, 3 Drawing Sheets

SMART BULLET

This application claims benefit of the Jul. 2, 1999, filing date of U.S. provisional patent application No. 60/142,146.

BACKGROUND OF THE INVENTION

The path of a gun-launched projectile is at the mercy of gravity, air currents, muzzle accuracy, barrel wear, sighting accuracy, gun stability, projectile anomalies, charge uniformity, etc. As with a golfer who leans after a shot to encourage the ball to travel one way or the other, one would similarly like to influence the flight path of a bullet to overcome the above disturbances and to deliver the projectile to its intended target. The least expensive weapon has, for the last several centuries, been a bullet. But although bullets are themselves, very inexpensive, they are not always the most cost effective. That is, the real cost of a bullet kill includes the cost of all the ammunition used to achieve the kill plus the cost of delivery. There are expenses of the gun, the vehicle that carries the gun and the various support systems. There is also an implied cost in personnel. The most cost-effective weapons consider all aspects of cost.

Most bullets spin about their axis and are thereby spin stabilized. Equipping such a projectile with guidance vanes or other control devices would be useless unless said control devices could be activated only at such times and for an appropriate duration when they could impose the appropriate control force, and then be retracted when their affect would be inappropriate or counter to correcting the flight path. Obviously such operation would mean very rapid projection and retraction of the guiding aspects, i.e. a wide bandwidth control system. The need for a wide bandwidth control system may be avoided by de-spinning the section of the projectile that houses the control devices. The de-spun section may then be roll stabilized with respect to inertial space. In such a state, the control section moving axially through the air could activate control devices without subjecting them to the roll of the bullet.

The following terms are generally understood in the art and are used herein with the following definitions:

Missile refers to a self-propelled, unmanned aircraft. Propulsion may be supplied by a rocket, jet or other kind of motor.

Projectile refers to gun launched, ballistic weapons. They have been unpropelled in the past, but several projectiles under development or contemplated also have rocket boost.

Bullet is a small projectile, typically 3 inches or less diameter.

Gyro is an angular rate sensor.

BRIEF SUMMARY OF THE INVENTION

Thus there is a particular need for an improved bullet capable of being delivered to an intended target in spite of the various influences that can set it off course. An object of this patent is to describe how a bullet in fight might correct an otherwise errant course when given the correcting information. Said information may come from outside the bullet, as in a command guidance system, or from and onboard auto-pilot. Another object of this invention is to achieve substantial cost reduction by making the bullet much more effective with only a modest increase in cost.

Accordingly, a bullet is described herein comprising: a spinning section adapted to rotate about an axis of flight; a control section rotatably connected to the spinning portion; a motor for de-spinning the control section relative to the axis of flight; a spoiler moveably connected to the control section; and an actuator connected between the control section and the spoiler for moving the spoiler between a withdrawn position and an extended position relative to the axis of flight. The bullet may further include a micro gyro attached to the control section and operable to generate a rotation signal responsive to the rotation of the control section about the axis of flight and a motor controller connected to the motor and having the rotation signal as an input and operable to control the motor in response to the rotation signal. In a further embodiment, the bullet is described as having a means for controlling the rotational position of the control section relative to the axis of fight so that a transverse force generated by the spoiler is oriented in a predetermined direction relative to the axis of flight, wherein the means for controlling the rotational position of the control section further comprises: a lens adapted for receiving an optical control signal; a detector disposed proximate the lens and operable to generate an electrical control signal responsive to the optical control signal; and an amplifier disposed on a flex circuit and connected to the detector for amplifying the electrical control signal, the flex circuit being bonded to the lens.

BRIEF DESCRIPTION OF THE DRAWINGS

FIG. 1 also illustrates the location of various armament and control portions of the bullet, including an optical detector and pre-amplifier circuit securely bonded to a rearward facing lens.

DETAILED DESCRIPTION OF THE INVENTION

Bullet Guidance. Most vehicles that fly through the air and are guided with other than by their original ballistic aiming have either stopped rolling or never rolled in flight. The concept disclosed herein is to merge the advantages of spin stabilization with the advantages of control sensitive non-rolling, hence a projectile that incorporates both.

This invention applies to smart bullets of medium caliber, that is, in the range about 15–65 mm. Bullets larger than this are big enough to house conventional lifting type control devices and their associated power supplies. Bullets smaller than this are too small for practical fabrication. The lower boundary of this range is limited by current manufacturing technology and may be expected to edge downward in the future.

If said control devices used to control a bullet were lift devices, such as wings, fins, etc., they could control the flight by turning and trimming in a manner that is in their domain. However, conventional lift devices have two major disadvantages for a bullet. First, the deployment and articulation of conventional wings or fins is difficult given the packaging limitations of the necessary aerodynamic surfaces, actuators and power supply in so small a volume as is available in a bullet. And second, lifting devices are relatively high-energy devices. Their power demand is high, which implies large batteries and further exacerbates the packaging problem.

Figure 1:
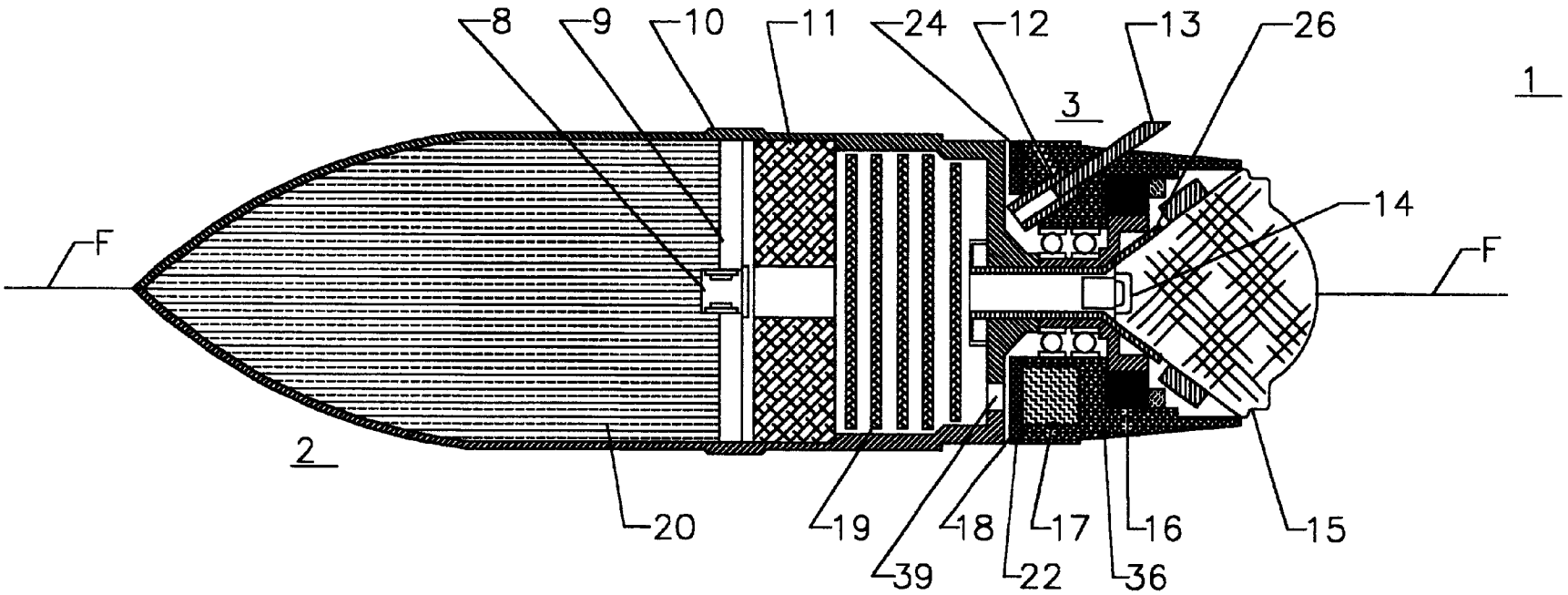
FIG. 1 is a cross-sectional view of a bullet having a spinning section and a deployable spoiler in a de-spun control section.

FIG. 1 illustrates a bullet 1 capable of responding to instructions received during its flight in order to change its direction of flight, i.e. a "smart" bullet. Bullet 1 is divided into two parts; a first spinning portion 2 rotating about an axis of flight F, and a control section 3 that is despun relative to the main portion 2 and the axis of flight F. The spinning energy is imparted to the bullet by the rifling of the barrel of the gun from which the bullet 1 is propelled. Control section 3 is despun relative to the spinning portion by motor 16 which has a first of its stator and rotor attached to the spinning portion 2 and a second of its stator and rotor attached to the control portion 3. Depending upon the speed of operation of motor 16, control section may be held stationary about axis of flight F, or it may be rotated to any predetermined orientation about axis of flight F.

Given a projectile that has a non-rolling section, said section may be fitted with air stream control elements with which to manipulate the flow field around the projectile and thereby effect a change in direction of the projectile's flight. Such elements may be, for example, airbrake(s), spoiler(s), rudder(s) or other devices that can distort the flow field on one side of the bullet thereby developing a control vector not parallel to the line-of-flight but also not having to operate with the rolling aspect. The bullet 1 of FIG. 1 includes one such control element, spoiler 13.

There is insufficient room in a bullet to house a conventional gyro, and even if there were, such a device probably could not sustain the gun launch loads. MEMS (Micro Electro-Mechanical Systems) inertial sensors, because they are small, strong, inexpensive and consume little power, are however, viable candidates for this application. MEMS accelerometers have been available for several years but MEMS gyros have lagged behind. However, several companies have recently claimed success in demonstrating a satisfactory MEMS gyro and units are expected to appear in the marketplace shortly. For example, Irvine Sensors Corporation discloses a silicon micro-ring gyro on its Internet web page at irvine-sensors.com. A MEMS gyro 22 is housed in the control section 3 as part of circuit 18 senses its roll motion. This information is fed back to a spin motor servo in the spinning portion 2. The servo controls the rotational speed of motor 16 such that the control section 3 is stabilized in the roll direction in inertial space about axis of flight F. Circuit 18 also includes a motor controller section connected to the spin motor servo and/or to the motor 16 for controlling the operation of motor 16.

Control Concepts. The dominant problem in the design of a smart bullet is the available volume. Conventional lifting type control devices (e.g. wings, fins, flaps, ailerons, elevons, slats, etc.) are relatively large and must be deployed into the air stream. The deployment/articulation mechanism consumes more volume. Furthermore, they are high-energy devices, which implies a large battery, exacerbating the problem. Conventional lifting type air stream control devices are too large for a bullet. But there are other ways to manipulate a flow field, such as a spoiler, which may be located in the nose or the tail of the bullet. Although spoilers are conventional aerodynamic control devices, they have never been used to control a bullet. A spoiler works by creating drag. It is therefore less effective than a lifting type device. It is deployed normal or at an angle to the flow and so deflects away from axis of flight F, thereby producing a transverse force. The force will rotate the bullet away from the spoiler, thereby orienting the bullet at an angle of attack relative to the air stream passing the bullet. The bullet will thereby develop body lift and move in response. Because of the way it works, a spoiler is necessarily an asymmetric device.

Although the spoiler itself may be a flat plate, as shown in FIG. 1, it can have any convenient cross-sectional shape, for example a rod, I-beam, tube, etc. For a bullet, a spoiler has the advantage that the force it generates is normal to it and therefore is reacted by the ways 12 that guide and support the spoiler 13. The spoiler's actuator 24 is connected between the spoiler 13 and the control section 3. Being in line with the spoiler 13, the actuator 24 is not subject to the drag load imposed on the spoiler 13 by the air stream. The actuator 24 need only be able to overcome the friction force between the spoiler 13 and its ways 12, which is much smaller than the drag force. The actuator 24 and its associated power supply can therefore be much smaller than would be required for a conventional lifting type control device.

Figure 2:
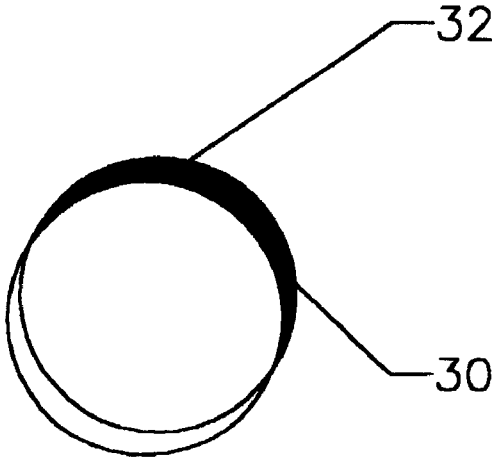
FIG. 2 is an end view of a bullet having a rotary actuator for deploying a spoiler.

The embodiment illustrated in FIG. 1 uses a linear actuator 24 for moving the spoiler 13 between the extended position, as shown, and a withdrawn position (not shown) where it is within the axial envelope of the bullet and out of the air stream. FIG. 2 illustrates a rear view of another embodiment of a smart bullet wherein a rotary actuator is used to deploy a generally crescent shaped spoiler 30 into the air stream. Prior to deployment the spoiler is at or within the bullet's mold line. The spoiler is deployed by rotating a disc or a portion of a disc about an axis parallel to the bullet's axis of fight, but displaced from it, as shown in FIG. 2. The wetted spoiler area exposed to the air stream when in the deployed position is shown in shown as area 32.

Figure 3:
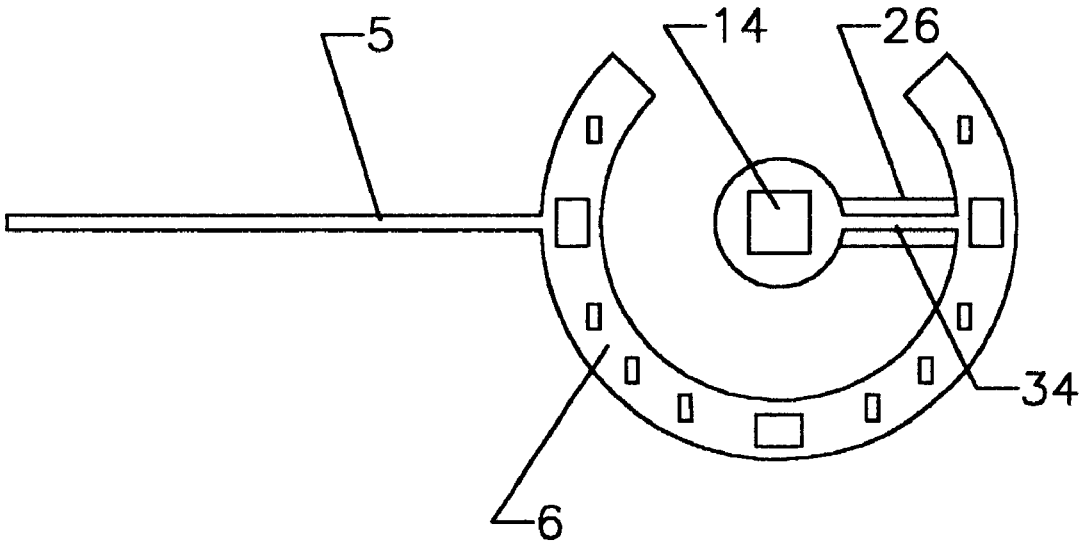
FIG. 3 is a plan view of the optical receiver of the bullet of FIG. 1.

Laser Receiver. The in-bore launch environment of the bullet (temperature, pressure, acceleration, etc.) is very severe. In particular, the acceleration results in inertial loads that tend to deform and otherwise damage. Optical devices are particularly vulnerable to deformation. This invention describes a laser receiver that is extremely strong and stiff. A laser receiver, illustrated both in FIG. 1 and in a flattened plan view in FIG. 3, includes a laser detector 14, optics to direct the light onto the detector in the form of lens 15, and a preamplifier circuit 6. Detector circuits are generally different from other circuits in that the signals they process are very small. Therefore, if the signal to noise ratio is to be adequately large, the noise must be kept very low. There are various types of electrical noise, one of which is microphonic noise. Microphonic noise arises in part from mechanical deformation of a circuit. When mechanical loads are imposed on a circuit element, it deforms and the conductors and other electrical elements are displaced relative to one another, thereby altering slightly the circuits capacitance, resistance and/or inductance. These effects make themselves apparent as electrical noise. After the preamplifier, the signals are larger and microphonic noise is seldom a problem. So the problem is localized in the preamplifier and the solution, in general, is to minimize the relative motion of the various circuit elements. The wires connecting the detector to the preamplifier must be short and well supported. If the wires are to be short, the preamplifier must be close to the detector.

The laser receiver is composed of electronics and optical aspects. The optical part is a single piece rearward facing lens 15. It has lens surfaces fore and aft, and includes means for mechanically fastening it to the structure of the spinning portion 2 and a mounting surface for the detector 14. Between the lens surfaces, the lens body may be a cylindrical or prismatic cone. The lens may be any material, for example, glass, plastic, quartz, etc., that that is sufficiently transparent at the laser's wavelength. It may be a cast, molded or machined part. A retro-reflector may be an applique bonded to the lens around its outer perimeter. Attached to the lens 15 or formed integral therewith is a structure 26 that provides a land for the detector 14 such that the detector 14 may be positioned a fixed distance from the lens 15. That structure 26 is arranged as a bridge between the detector 14 and its preamplifier circuit 6 which is bonded to the lens, such as with an epoxy or other appropriate adhesive. The lens body therefore supports the detector 14, its preamplifier 6 and the bridge 26 there between. The electronic aspect of the laser receiver may be a single piece flex circuit that includes the detector and its associated preamplifier. Flex circuits are a common design and fabrication feature in aerospace technologies. The circuit is fabricated as a simple flat part that may be rolled or folded, except for the detector itself, into a cylindrical or prismatic conical shape to match the lens so that it can be bonded to the lens. The detector 14 is located on a tab 34 protruding from the preamplifier portion of the circuit. The bonding process may include an assembly fixture that will hold the detector in place (position and attitude) relative to the lens during bonding. The flex circuit contains the amplifier wires thereby minimizing their relative motion. Bonding the circuit to the lens supports it over its entire surface, inhibiting the relative motion of the preamplifier components and further reducing the relative motion of the wires.

The smart bullet shown in FIG. 1 includes a warhead, power supply, an electronics assembly 19 which is the central command center, and a control section. A blast shield may be needed to protect the lens and the gap between the rotating and non-rotating portions of the bullet. The control section 3 shown in FIG. 1 is aft mounted, however, in an alternate configuration it could be nose mounted.

Electrical power is required in the spinning portion 2 for the receiver, command center, internal communications and the spin motor. Power is also required in the control section 3 for the gyro 22, internal communications and the actuator 13. This can be accomplished with a single power supply, or with two separate power supplies, a design choice. Using two batteries 11,17, as is shown in FIG. 1, avoids the need for slip rings to deliver power between the sections 2,3 of the bullet 1.

The electronics assembly 19 may be fabricated as a single flex circuit, folded into a stack as shown in FIG. 1, and potted in place. Potting two or more boards into a stack makes them function structurally as a sandwich, thereby making the assembly very strong. They can be potted with syntactic or other foam to save weight or with a conventional potting material. Although illustrated with an optical receiver, a bullet 1 may alternatively have a radio frequency receiver or its own auto-pilot. The control section housing may be metal or plastic, machined, cast or molded depending on cost and strength considerations. The control section 3 is supported relative to the spinning section 2 by bearings 36, e.g. journal, ball, needle, roller, etc.

Mounted between the control section 3 and the spinning section 2 is the spin motor 16, whose stator is mounted to one section and whose rotor is mounted to the other. A printed circuit board 18 is mounted to the control section. Included in the circuit is a roll gyro 22, a power supply (including battery 17), a spoiler actuator 24 and its driver.

Information is transmitted back and forth between the spinning portion 2 of the bullet and the control section 3 over an internal optical link 39. When two power sources are provided, as illustrated, no power need be transmitted between the sections of the bullet 1. Alternatively, using slip rings between the sections would allow both information and power to be transmitted there between. With slip rings, only one power source would be required and it can be in either section. The optical link is composed of two transceivers. A transceiver is a device that can both transmit and receive. One is located in each section and they look at one another across a small gap between the control section and the spinning portion of the bullet. With the two transceivers moving relative to one another, one cannot always see the other. They must stay on alert and when one acquires the other, it will transmit and/or receive in accordance with any accumulated messages. Since the transceivers are aligned only briefly with each relative revolution of the two sections of the bullet, messages must be brief and transmission quick to be completed before they are once again out of range. Typically, bullets spin at around 200 Hz., which means that a revolution takes about 5 milliseconds. If the optics of the transceivers is such that they have a 30 field of view, less than 0.5 milliseconds is available for transmission during each revolution. Because the communications medium is a laser and has a very wide bandwidth, the available transmission time should be adequate.

The spoiler 13 is shown in a deployed condition. The spoiler may be oriented normal to the flow field or at an angle as shown. The distance and duration the spoiler is deployed into the air stream will depend on the agility required of the bullet for different missions. The spoiler must strong and stiff enough to sustain gun launch and maneuver loads. The maneuver loads will depend on the mission for which it is designed. It may be made of metal or plastic, perhaps reinforced, and may be machined, cast or molded.

The spoiler is guided and supported by ways 12. The ways are the primary load path for the drag loads on the spoiler to be transferred to the primary structure. This avoids the need for the actuator to be in the primary load path. It is therefore subjected to far smaller loads than it would otherwise experience. The ways may be rails or channels or another type of beam-like structure whose function is to support and guide the spoiler 13. They are the primary load path between the spoiler and the control section housing and must be strong. Since they must also offer a minimum of friction to spoiler motion, they may be polished and/or lubricated and/or coated with a low friction coating and/or incorporate bearings. Alternatively, the spoiler may be supported by a flange or other shelf-like structure.

The spoiler 13 can be actuated by a linear actuator 12 that is a linear motor (electric or fluid) or a solenoid. Alternately, the spoiler can be deployed by a rotary actuator as shown in FIG. 2.

The bullet 1 is fired by a rifled gun (not shown) equipped with a sight that can track both the bullet and the target simultaneously. The gun imparts a spinning motion on the entire bullet, including the withdrawn spoiler. The sight monitors the trajectory of the bullet and the target, and determines any error or desired change in the flight path necessitating a desired control maneuver. The sight transmits an appropriate control signal to the bullet via RF, IR, or optical signal. Within the bullet, the control signals are received, interpreted and commands generated, as illustrated by the functional block diagram of FIG. 4. There are two parts to a control command: orientation and amplitude. The orientation command will be superimposed on the spin motor control signal so that the control section rotates in inertial space to the desired angular position. The amplitude command is sent to the control section, relayed to the spoiler actuator, which executes the command. The initial control action is to calibrate the round in flight. Directional ambiguity is then resolved by executing a pulse command in one of the orthogonal directions and observing the direction of response, thus calibrating the round in flight. A reverse pulse will put the bullet back on course.

Figure 4:
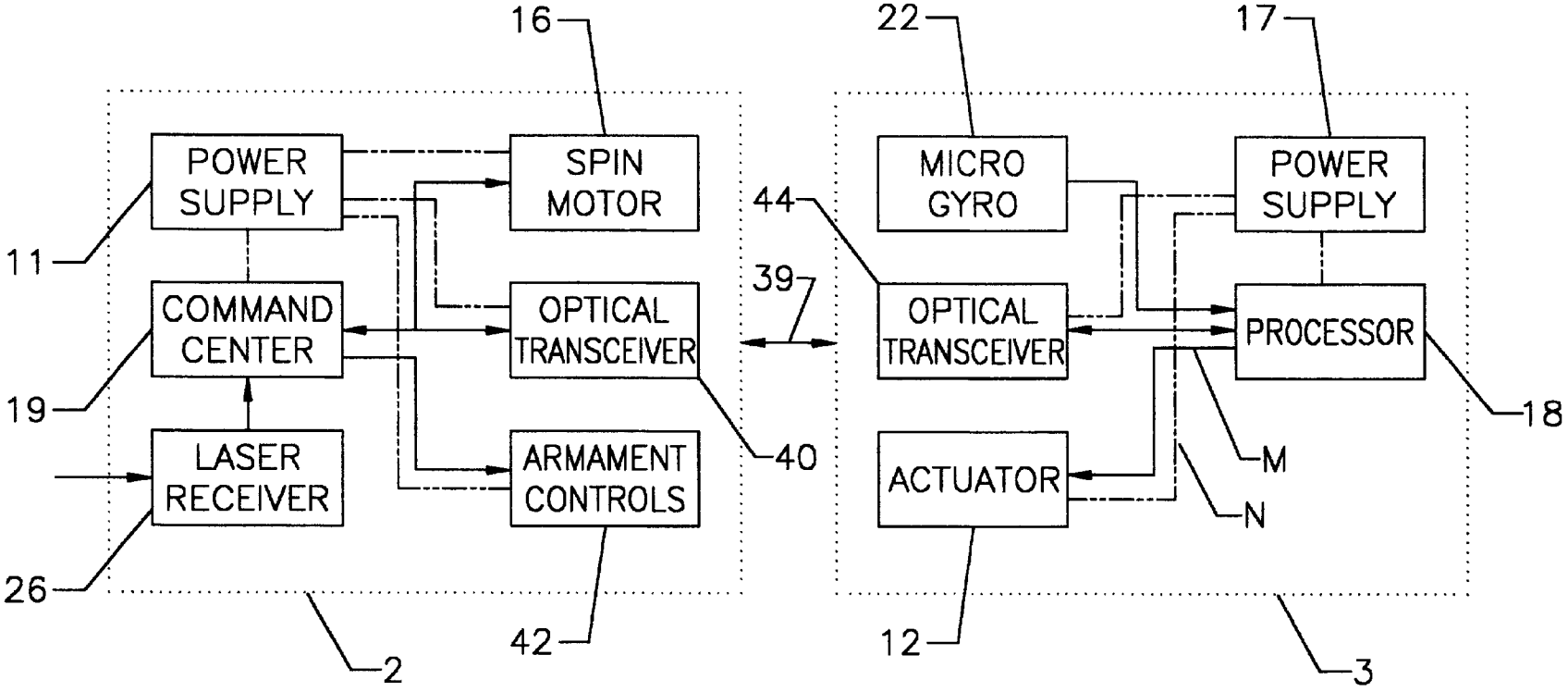
FIG. 4 is a block diagram illustrating the major systems of the bullet of FIG. 1 indicating the portion of the bullet in which those systems are located.

FIG. 4 is a block diagram illustrating the various systems of the bullet 1. The spinning portion 2 includes a power supply 11, electronic command center 19, laser receiver 26, internal optical communications transceiver, and armament controls 42. The spinning portion 2 is also illustrated as containing the spin motor 16, although it is recognized that the motor may act as a connection between the two portions of the bullet and may be considered part of either or both portions. The control section 3 contains the micro gyro 22, a optical transceiver 44, the control device actuator 12, a power supply 17, and control section processor 18. Although other embodiments may employ these various components in other locations within the bullet, it is generally desirable to minimize the mass and angular inertia of the control section in order to improve its responsiveness to control inputs and to reduce the amount of power necessary for control functions. The micro gyro 22 is operable to provide a rotation signal responsive to the rate of rotation of the de-spun control section 3 about the axis of flight F of the bullet 1. The motor controller portion of the electronic command center 19 receives the rotation signal as an input and is operable to control the motor 16 to control the rotation of the control section 3 about the axis of flight in response thereto. Laser receiver 26 is operable to receive an optical control signal and to produce an electrical control signal in response thereto for directional control of the bullet 1. Electronic command center 19 receives the electrical control signal as an input and through the motor controller is operable to control the operation of spin motor 16 to position the actuator 13 in the appropriate position and to extend the spoiler 13 into the air stream for an appropriate time period so that a transverse force generated by the spoiler 13 is oriented in a predetermined direction relative to the axis of flight F.

Design Considerations. Usually bullets are fired at passive targets. For these missions the control system need only correct for the kinds of perturbations listed above. The corrections will be relatively small, the accelerations the bullet must undergo, minor. Such a bullet will not be particularly agile. For missions against slowly moving targets (i.e. surface vehicles or personnel) somewhat more agility will be necessary. For missions against airborne targets, that may be employing evasive maneuvers, very great agility may be required. The control system is therefore a mission dependant design. Missions that require more agility imply the need for a bigger spoiler and/or actuator. They may also require a quicker control system.

Most bullets do not have warheads. They are called hit-to-kill or kinetic energy weapons. However, the next generation of bullets may include warheads, which will necessitate a safe-and-arm and fuse. The warheads may be different, i.e. pyrotechnic, fragmentation, explosively formed projectile (EFP), etc. depending on the mission.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A projectile comprising:

a casing having a caliber in the range of 15–65 mm;

a spinning section;

a de-spun section rotatably attached to the spinning section;

a drag-creating air stream control element moveably attached to the de-spun section, the drag-creating air stream control element having a first position withdrawn into the de-spun section and a second position protruding from the de-spun section into an air stream passing the projectile.

2. The projectile of claim 1, further comprising:

a motor connected between the spinning section and the de-spun section;

a micro gyro disposed in the de-spun section for providing a rotation signal responsive to the rate of rotation of the de-spun section about an axis of flight of the projectile;

a motor controller connected to the micro gyro and having the rotation signal as an input and and connected to the motor for controlling the operation of the motor to control the rate of rotation of the de-spun section about the axis of flight.

3. The projectile of claim 2, further comprising:

a control signal receiver disposed within the casing for producing an electrical control signal responsive to an optical control signal;

wherein the motor controller receives the electrical control signal as an input and is responsive to control the motor in response thereto.

4. The projectile of claim 3, further comprising:

a linear actuator connected between the drag-creating air stream control element and the de-spun section for moving the drag-creating air stream control element between the first position and the second position by sliding the drag-creating air stream control element along ways supporting the drag-creating air stream control element.

5. The projectile of claim 4, wherein the control signal receiver further comprises:

a lens attached to the spinning section for receiving the optical control signal and for directing the optical control signal to a detector for producing the electrical control signal in response to the optical control signal.

6. The projectile of claim 5, further comprising a pre-amplifier circuit connected to the detector, the pre-amplifier circuit comprising a flex circuit bonded to the lens.

7. The projectile of claim 1, further comprising an optical communications link between the spinning section and the de-spun section.

8. The projectile of claim 1, further comprising a motor having a first of a stator and rotor attached to the spinning section and having a second of the stator and rotor attached to the de-spun section.

9. A projectile comprising:

a casing having a maximum outside diameter in the range of 15–65 mm;

a spinning section;

a control section rotatably connected to the spinning portion along an axis of flight;

a motor connected between the spinning section and the control section for providing relative rotation there between along the axis of flight;

a drag-creating air stream control element moveably connected to the control section;

an actuator connected between the control section and the drag-creating air stream control element for moving the drag-creating air stream control element between a withdrawn position and an extended position relative to the axis of flight.

10. The projectile of claim 9, further comprising:

a micro gyro attached to the control section for generating a rotation signal responsive to the rotation of the control section about the axis of flight;

a motor controller connected to the motor and having the rotation signal as an input for controlling the motor in response to the rotation signal.

11. The projectile of claim 9, further comprising:

a means for controlling the rotational position of the control section relative to the axis of flight so that a transverse force generated by the drag-creating air stream control element spoiler is oriented in a predetermined direction relative to the axis of flight.

12. The projectile of claim 11, wherein the means for controlling the rotational position of the control section further comprises:

a lens attached to the control section;

a detector positioned to receive an optical control signal passing through the lens for generating an electrical control signal responsive to the optical control signal;

an amplifier disposed on a flex circuit and electrically connected to the detector for amplifying the electrical control signal, the flex circuit being bonded to the lens.

13. A projectile comprising:

a spinning section having an axis of flight;

a control section rotatably connected to the spinning portion along the axis of flight;

a motor for de-spinning the control section relative to the spinning section along the axis of flight;

a lens connected to the spinning section;

a detector supported by the lens for receiving an optical control signal passing through the lens and for generating an electrical control signal responsive to the optical control signal;

an amplifier disposed on a flex circuit and connected to the detector for amplifying the electrical control signal, the flex circuit being bonded to the lens; and a motor controller connected to the amplifier for controlling the motor in response to the electrical control signal.

14. The projectile of claim 13, further comprising:

a drag-creating air stream control element;

an actuator attached between the drag-creating air stream control element and the control section for moving the drag-creating air stream control element between an extended position and a withdrawn position relative to the axis of flight; and a controller for controlling the actuator in response to the electrical control signal.

15. A method of delivering a projectile to a target, the method comprising the steps of:

providing a projectile with a caliber in the range of 15–65 mm and having a spinning section and a control section rotatably attached to the spinning section;

providing a drag-creating air stream control element attached to the control section on a single side of the projectile, the drag-creating device having a withdrawn position and an extended position;

firing the projectile from a rifled gun with the drag-creating device in the withdrawn position to impart a spinning rotation to the projectile about an axis of flight;

monitoring the trajectory of the projectile to determine a desired control maneuver relative to the axis of flight;

de-spinning the control section so that the spoiler assumes a desired position relative to the axis of flight;

moving the drag-creating air stream control element to an extended position to create drag on a single side of the projectile to accomplish the desired control maneuver.

16. A projectile comprising:

a casing having a caliber selected for an in-bore launch;

a laser receiver attached to the casing for receiving an optical guidance signal and for producing an electrical guidance signal; and a control element attached to the casing and responsive to the electrical guidance signal for guiding the projectile in flight;

wherein the laser receiver further comprises:

a laser detector;

a lens for directing the optical guidance signal onto the laser detector; and an amplifier circuit connected to the laser detector;

wherein the detector and the amplifier circuit are attached to the lens.

17. The projectile of claim 16, wherein the amplifier circuit comprises a flex circuit bonded to the lens.

18. A projectile comprising:

a casing having a caliber of no more than 65 mm;

a spinning section;

a de-spun section rotatably attached to the spinning section;

a drag-creating air stream control element moveably attached to a single side of the de-spun section, the drag-creating air stream control element having a first position withdrawn into the de-spun section and a second position protruding from the de-spun section into an air stream passing along the single side of the projectile.

* * * * *